US009586744B2

(12) United States Patent
Arent et al.

(10) Patent No.: US 9,586,744 B2
(45) Date of Patent: Mar. 7, 2017

(54) FLEXIBLE CONTAINER WITH DISPENSING AID

(71) Applicant: The Procter & Gamble Company, Cincinnati, OH (US)

(72) Inventors: Lee Mathew Arent, Fairfield, OH (US); Donald Joseph Cox, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/334,784

(22) Filed: Jul. 18, 2014

(65) Prior Publication Data

US 2015/0028057 A1 Jan. 29, 2015

Related U.S. Application Data

(60) Provisional application No. 61/858,243, filed on Jul. 25, 2013.

(51) Int. Cl.
*B65D 35/28* (2006.01)
*B65D 75/58* (2006.01)

(52) U.S. Cl.
CPC .... *B65D 75/5811* (2013.01); *B65D 2231/001* (2013.01)

(58) Field of Classification Search
CPC ..... B65D 75/5811; B65D 2231/001; B65D 35/10; B65D 35/28; B65D 35/32; B65D 35/34; B65D 83/0055; B65D 83/0094
USPC ..... 222/99, 101, 212, 491
See application file for complete search history.

(56) References Cited

U.S. PATENT DOCUMENTS

| | | | | |
|---|---|---|---|---|
| 3,401,837 | A * | 9/1968 | Wiedeman | 222/99 |
| 3,458,087 | A * | 7/1969 | Cox, Jr. | 222/99 |
| 3,581,944 | A | 6/1971 | Jeppesen | |
| 3,604,595 | A * | 9/1971 | Wiedeman | 222/99 |
| 4,163,509 | A | 8/1979 | Amneus | |
| 4,377,192 | A * | 3/1983 | Gautier | 383/7 |
| 4,603,433 | A * | 7/1986 | Gautier et al. | 383/7 |
| 4,717,046 | A * | 1/1988 | Brogli | 222/107 |
| 4,792,060 | A * | 12/1988 | Brogli | 222/107 |
| 4,898,280 | A * | 2/1990 | Runge | 383/200 |
| 4,921,137 | A * | 5/1990 | Heijenga | 222/107 |
| 5,348,155 | A | 9/1994 | Ishiwa | |

(Continued)

FOREIGN PATENT DOCUMENTS

| | | |
|---|---|---|
| CN | 1389378 A | 1/2003 |
| CN | 1406826 | 4/2003 |

(Continued)

*Primary Examiner* — Patrick M Buechner
(74) *Attorney, Agent, or Firm* — Charles R. Ware

(57) ABSTRACT

A flexible container including a first web portion defined by a first periphery, and a second web portion defined by a second periphery. The second web portion may be disposed in a face to face relationship with the first web and at least partially overlapping the first web. At least a portion of the second periphery may be bonded or sealed to the first web, the sealed portion defines a first product volume. The container further includes a dispensing aid disposed adjacent to the sealed portion of the second periphery and may include a dispensing valve. The dispensing aid includes third and fourth web portions sealed along a closed periphery and defining an expanded volume or structural support volume.

20 Claims, 2 Drawing Sheets

(56) References Cited

U.S. PATENT DOCUMENTS

| | | | | |
|---|---|---|---|---|
| 5,467,897 | A * | 11/1995 | Williams | 222/107 |
| 5,935,659 | A | 8/1999 | Cane et al. | |
| 6,761,288 | B2 | 7/2004 | Garcia | |
| 7,007,823 | B2 * | 3/2006 | Jackson | 222/99 |
| 7,819,582 | B2 * | 10/2010 | Rosen | 383/7 |
| 7,922,045 | B2 | 4/2011 | Ianna et al. | |
| 8,061,563 | B1 | 11/2011 | Rosen | |
| 2003/0015549 | A1 | 1/2003 | Yoshida | |
| 2004/0264816 | A1 * | 12/2004 | Carter | 383/207 |
| 2011/0182533 | A1 * | 7/2011 | Scott | 383/119 |
| 2012/0125947 | A1 * | 5/2012 | Becker et al. | 222/105 |
| 2012/0187147 | A1 * | 7/2012 | Lightfoot | 222/103 |
| 2013/0292287 | A1 | 11/2013 | Stanley et al. | |
| 2013/0292353 | A1 | 11/2013 | Stanley et al. | |
| 2013/0292395 | A1 | 11/2013 | Stanley et al. | |
| 2013/0292413 | A1 | 11/2013 | Stanley et al. | |
| 2013/0292415 | A1 | 11/2013 | Stanley et al. | |
| 2013/0294711 | A1 | 11/2013 | Stanley et al. | |
| 2013/0337244 | A1 | 12/2013 | Stanley et al. | |
| 2014/0033654 | A1 | 2/2014 | Stanley et al. | |
| 2014/0033655 | A1 | 2/2014 | Stanley et al. | |
| 2015/0028057 | A1 * | 1/2015 | Arent et al. | 222/107 |

FOREIGN PATENT DOCUMENTS

| | | |
|---|---|---|
| CN | 2815919 U | 9/2006 |
| DE | 202004009084 | 12/2004 |
| EP | 2574567 | 3/2013 |
| GB | 2458222 | 3/2009 |
| JP | 2000109103 | 4/2000 |
| JP | 2003291993 | 10/2003 |
| TW | 200936461 | 9/2009 |

* cited by examiner

FLEXIBLE CONTAINER WITH DISPENSING AID

FIELD OF THE INVENTION

The present disclosure relates in general to the field of product containers. The disclosure relates particularly to the field of flexible containers.

BACKGROUND OF THE INVENTION

Consumer products include liquid products and/or pourable solid products. In various embodiments, a container can be used to receive, contain, and dispense one or more products. And, in various embodiments, a container can be used to receive, contain, and/or dispense individual articles or separately packaged portions of a product. A container can include one or more product volumes. A product volume can be configured to be filled with one or more products. A container receives a product when its product volume is filled. Once filled to a desired volume, a container can be configured to contain the product(s) in its product volume(s), until the product(s) is/are dispensed. A container contains a product by providing a barrier around the product. The barrier prevents the product from escaping the product volume. The barrier can also protect the product from the environment outside of the container. A filled product volume is typically closed off by a cap or a seal. A container can be configured to dispense one or more products contained in its product volume(s). Once dispensed, an end user can consume, apply, or otherwise use the product(s), as appropriate. In various embodiments, a container may be configured to be refilled and reused or a container may be configured to be disposed of after a single fill or even after a single use. A container should be configured with sufficient structural integrity, such that it can receive, contain, and dispense its product(s), as intended, without failure.

A container can be configured to dispense product(s) through the use of gravity, and/or pressure, and/or a dispensing mechanism, such as a pump, or a straw, or through the use of other kinds of dispensers known in the art. Efforts to dispense products from flexible containers typical result in incomplete dispensing of the products. In some instances as much as 20% of the product may remain un-dispensed and therefore unused by the consumer.

What is desired is a cost-effective mechanism for improving the extent to which product is dispensed from a flexible container.

SUMMARY OF THE INVENTION

In one aspect, a flexible container may comprise a first web portion defined by a first periphery, and a second web portion defined by a second periphery. The second web portion may be disposed in a face to face relationship with the first web and at least partially overlapping the first web. At least a portion of the second periphery may be bonded or sealed to the first web, the sealed portion defines a first product volume. The container further comprises a dispensing aid disposed adjacent to the sealed portion of the second periphery. The dispensing aid comprises third and fourth web portions sealed along a closed periphery and defining an expanded volume or structural support volume.

In one aspect, a flexible container comprises: a first web portion defined by a first periphery, a second web portion defined by a second periphery and disposed in a face to face relationship with the first web and at least partially overlapping the first web, at least a portion of the second periphery sealed to the first web, the sealed portion defining a first volume, a dispensing aid disposed adjacent to the sealed portion of the second periphery, and a dispensing valve comprising first and second expanded volumes disposed adjacent one to the other and defining a gap therebetween. The dispensing aid comprises third and fourth web portions sealed along a closed periphery and defining an expanded volume. Each of the expanded volumes comprise sub-portions of the first and second web portions sealed along a closed periphery. The gap comprises sub-portions of the first and second web portions arrayed in a face to face relationship. The dispensing valve is disposed adjacent to the first volume.

DETAILED DESCRIPTION OF THE INVENTION

Figure 1:
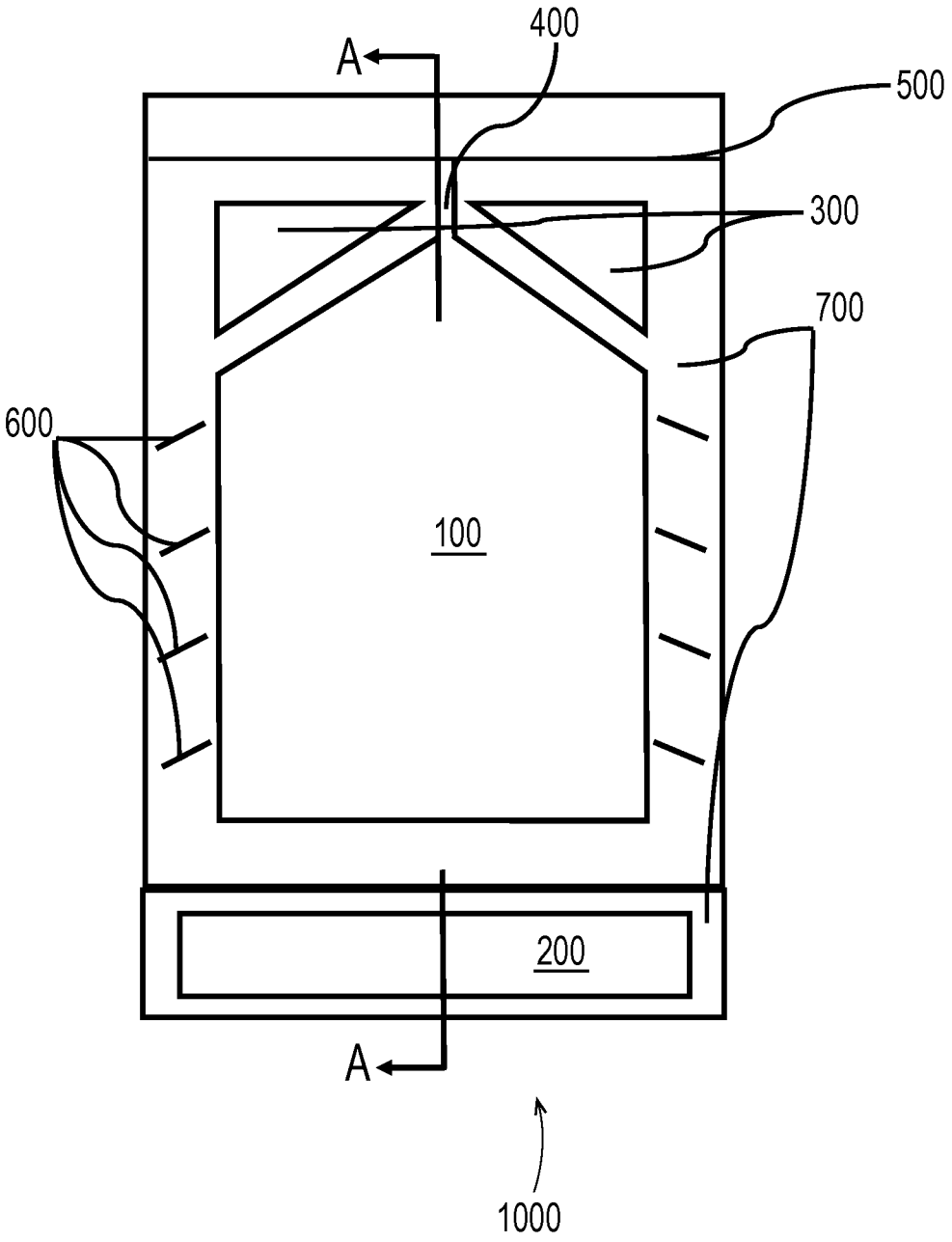
FIG. 1 provides a schematic plan view of one embodiment of the invention.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", "sheet-like material" and "web" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. In various embodiments, part, parts, or all of a flexible material can be coated or uncoated, treated or untreated, processed or unprocessed, in any manner known in the art. In various embodiments, parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque. The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these. Exemplary flexible materials further include: 82 um (~3 mil) Coextrusion—PE/Tie/EVOH/Tie/PE; 12 um PET/Adh/18 um vmBOPP/Adh/40 um PE-Tie-EVOH-Tie-PE Coextrusion Sealant; and 12 um PET/Adh/40 um vmPE-Tie-EVOH-Tie-PE Coextrusion Sealant.

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multi-layer panel), and structures with flexible materials that are not configured to be expanded by an expansion material (e.g. a space in a structure that is configured to be a non-structural panel). Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein. Flexible containers, as described herein, may be used across a variety of industries for a variety of products. For example, flexible containers, as described herein, may be used across the consumer products industry, including the following products: soft surface cleaners, hard surface cleaners, glass cleaners, ceramic tile cleaners, toilet bowl cleaners, wood cleaners, multi-surface cleaners, surface disinfectants, dishwashing compositions, laundry detergents, fabric conditioners, fabric dyes, surface protectants, surface disinfectants, cosmetics, facial powders, body powders, hair treatment products (e.g. mousse, hair spray, styling gels), shampoo, hair conditioner (leave-in or rinse-out), cream rinse, hair dye, hair coloring product, hair shine product, hair serum, hair anti-frizz product, hair split-end repair products, permanent waving solution, antidandruff formulation, bath gels, shower gels, body washes, facial cleaners, skin care products (e.g. sunscreen, sun block lotions, lip balm, skin conditioner, cold creams, moisturizers), body sprays, soaps, body scrubs, exfoliants, astringent, scrubbing lotions, depilatories, antiperspirant compositions, deodorants, shaving products, pre-shaving products, after shaving products, toothpaste, mouthwash, etc. As further examples, flexible containers, as described herein, may be used across other industries, including foods, beverages, pharmaceuticals, commercial products, industrial products, medical, etc.

A flexible container may comprise a first web portion defined by a first periphery, and a second web portion defined by a second periphery. The second web portion may be disposed in a face to face relationship with the first web and at least partially overlapping the first web. The first and second portions may be coextensive or of dissimilar size and shape. At least a portion of the second web may be bonded or sealed to the first web, the sealed portion defines a first product volume. The sealed portion may comprise an open or closed perimeter to define the product volume. The sealed portion may constitute an open perimeter leaving a portion of the overall perimeter unsealed, defined as a gap in the otherwise sealed perimeter, and thereby affording an egress point for product from the product volume.

The product volume may be subdivided into multiple volumes by the presence of additional sealed perimeters between the first and second webs. The first and second web portions may constitute discrete web elements or may be portions of a single larger web folded over upon itself, placing the first and second portions in the required face-to-face relationship.

In instances where the sealed portion comprises a closed perimeter, the container may further comprise a frangible seal, or other form of weak point, of the container to facilitate breaching the closed perimeter thereby enabling dispensing of the product within the container. The frangible seal may be in the form of a partial breach of the sealed perimeter. A perforation, or cut, transverse to the sealed perimeter and extending only part way across the perimeter constitutes an exemplary weak point. The frangible seal may be of the form of a line of perforations across the container reducing the force required to remove a portion of the container, creating a gap in the perimeter of the product volume and affording access to the product within the volume.

The container further comprises a dispensing aid disposed adjacent to the sealed portion of the second periphery. The dispensing aid comprises third and fourth web portions sealed along a closed periphery and defining an expanded volume, or structural support volume. The third and fourth web portions may constitute discrete web portions disposed in a face-to-face relationship. The web portions may be substantially similar in shape and size or may be dissimilar in shape and/or size. A single larger web portion may be folded upon itself creating the face-to-face relationship of the portions. The web portions of the dispensing aid may constitute portions of the first and second webs forming the product volume. The first and third, and second fourth webs may be single webs, three of the four portions may constitute a single web, and in one embodiment, all four web portions may constitute a single web folded upon itself.

The dispensing aid may be disposed in opposition to the perimeter gap or the frangible seal, or may otherwise be disposed along an edge of the perimeter or at an angle other than about ninety degrees to the gap or frangible seal.

In use, the dispensing aid may be rolled, or folded, along a dispensing path, compressing the product volume and forcing the expulsion of product from the volume via the gap.

The flexible container may further comprise a dispensing stabilization aid disposed along the dispensing path of the dispensing aid. The stabilization aid may comprise a mechanical structure formed in the container, an adhesive or cohesive material arrayed upon the surface of the container along the path to facilitate the retention of the position of the dispensing aid as it is translated along the dispensing path. In one embodiment, a series of slits, closed at both ends, may be arrayed along the dispensing path such that portions of the periphery of the dispensing aid may be passed through the slits to capture and retain the dispensing aid in discrete positions as it is translated along the dispensing path thereby preventing any resilience of the flexible container from causing the container to unroll or unfold, counteracting the efforts to dispense product.

The slits may be linear, or curvilinear, irregular, or a combination of these, and may be made in one or both of the first and second web portions. The slits may be made in the sealed perimeter of the product volume of in portions of the web extending beyond that perimeter.

In one embodiment, the container may further comprise a dispensing valve for regulating product dispensing. The valve may comprise first and second expanded volumes disposed adjacent one to the other and defining a gap therebetween. Without being bound by theory, it is believed that the expanded volumes impart tension to the film keeping the container closed and that internal pressure in the product imparted by squeezing the container overcomes this tension and leads to dispensing of the product. The valve may be disposed at one end of the product volume. The expanded volumes, or structural support volumes, constitute expanded volumes configured from portions of the first and second web portions. The gap comprises portions of the first and second webs arrayed in a face-to-face relationship yet unsealed one to the other. The gap may be considered to have a width between the two expanded volumes, as well as a length defined as the distance over which the width of the gap is maintained. The ratio of the length to the width may be varied to alter the ease of dispensing through the gap, also taking into consideration the viscosity of the product. The shape of the expanded volumes of the valve may be rectilinear, triangular or any other regular polygonal shape. The volumes may be crescent shaped or otherwise curvilinear in shape as well. The shape and/or orientation of the expanded volumes may contribute to a tapering of the volume of the product volume in the direction of the gap from the main volume of the product volume. The volumes may serve to reduce the width of the product volume portion of the package from a first width to a substantially smaller second width. This tapering may serve to constrain the movement of product as pressure is applied to the product volume and may cause the product to flow toward the gap as the pressure is applied.

The frangible seal may be incorporated into containers comprising the valve. In one embodiment, the seal may be disposed adjacent to the valve in a location more distant from the product volume than the valve. The container may comprise the valve, the dispensing aid or the combination of the valve and the dispensing aid. The dispensing aid can be very helpful in creating a pool of product within the product volume and adjacent to the dispensing valve as the product volume is reduced. This pool may make it easier to create the internal pressure needed to facilitate dispensing the product. In this way, the dispensing aid and dispensing valve work synergistically to aid the consumer to efficiently dispense the product.

In one aspect, the invention may be considered as a single flat film adapted to be folded upon itself and selectively sealed to itself to form the product volume and structural volumes. In this aspect, provision may be made to leave access to the intended structural volumes such that a gas or expandable liquid may be inserted into the structural spaces prior to sealing the access ports to those volumes. In one embodiment, a gas, air, nitrogen, $CO_2$ argon, etc may be inserted into the structural volumes and the access portion subsequently sealed. To better facilitate the sealing of the access portions, liquid nitrogen, or other liquefied gas, or a solidified gas, such as dry ice, solidified $CO_2$, may be inserted into the structural elements and the access portions subsequently sealed. The use of the liquid or solid form may provide a time for sealing the access portions during which the internal pressure of the volume has not yet begun to rise thereby making the sealing operation easier and less prone to leaks across the seal.

Examples

A product sachet was prepared using two portions of 12 um PET/Adh/18 um vm BOPP/Adh/40 um Coextrusion—PE/Tie/EVOH/Tie/PE. The sachet comprised a product volume adapted to contain about 40 ml of a consumer product. The container further comprised a roll bar dispensing aid disposed at one end of the container having a diameter of about 7/16" (11 mm). The sachet had an overall length of about 5.5" (140 mm) and a width of about 3" (76 mm). The sachet comprised two expanded chambers having substantially triangular cross sections disposed opposite to the roll bar dispensing aid.

A product sachet was prepared using two portions of 12 um PET/Adh/18 um vm BOPP/Adh/40 um Coextrusion—PE/Tie/EVOH/Tie/PE. The sachet comprised a product volume adapted to contain about 20 ml of a consumer product. The container further comprised a roll bar dispensing aid disposed at one end of the container having a diameter of about 7/16" (11 mm). The sachet had an overall length of about 4" (102 mm) and a width of about 2.5" (64 mm). The sachet comprised two expanded chambers having substantially triangular cross sections disposed opposite to the roll bar dispensing aid.

Figure 2:
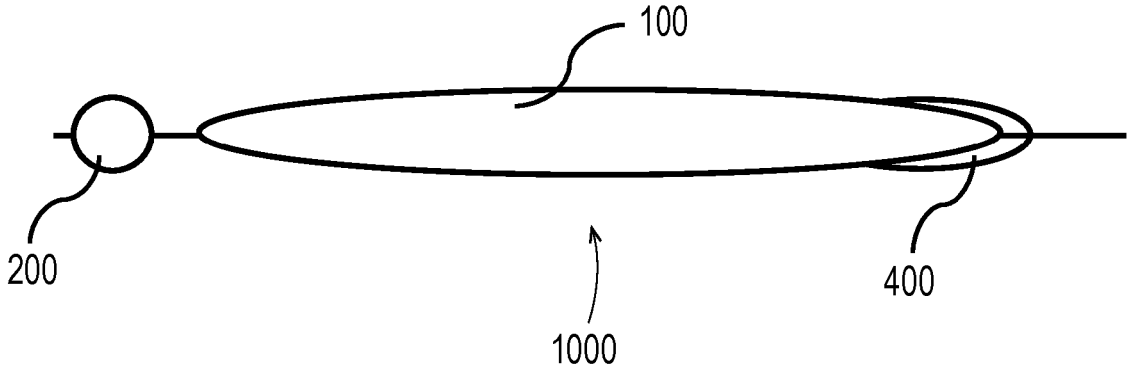
FIG. 2 provides a schematic side view of the embodiment of FIG. 1 along section line AA.

As illustrated in FIGS. 1 and 2, a product sachet, 1000, includes a product volume 100, a dispensing aid 200, structural elements 300, which define a gap 400 for dispensing the product. Frangible seal 500 facilitates the easy removal of a portion of the sachet to enable the dispensing of the product via the gap 400. The sachet may be formed by sealing portion of film to each other to form the product volume 100, the dispensing aid 200, and the structural elements 300. The sealed portions of the sachet 700 may be formed by heat sealing film portions together. The dispensing stabilization elements 600 are disposed along the path of the dispensing aid 200 toward the gap 400. In conjunction with folding or rolling the sachet using the dispensing aid 200, the stabilizing elements 600 enable the sachet to be maintained in a partially folded or rolled up position.

The surfaces of the film elements may be utilized as billboard spaces and may comprise indicia. The indicia may be printed upon the surfaces utilizing printing processes as are know in the art. Exemplary printing processes include: flexographic printing, gravure printing, and other offset printing methods, hot stamp decorations and embossing, laminating, and other film decoration methods may also be employed in configuring the outward appearance of the package.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: (1) U.S. non-provisional application Ser. No. 13/888,679 filed May 7, 2013, entitled "Flexible Containers" and published as US20130292353 (applicant's case 12464M); (2) U.S. non-provisional application Ser. No. 13/888,721 filed May 7, 2013, entitled "Flexible Containers" and published as US20130292395 (applicant's case 12464M2); (3) U.S. non-provisional application Ser. No. 13/888,963 filed May 7, 2013, entitled "Flexible Containers" published as US20130292415 (applicant's case 12465M); (4) U.S. non-provisional application Ser. No. 13/888,756 May 7, 2013, entitled "Flexible Containers Having a Decoration Panel" published as US20130292287 (applicant's case 12559M); (5) U.S. non-provisional application Ser. No. 13/957,158 filed Aug. 1, 2013, entitled "Methods of Making Flexible Containers" published as US20140033654 (applicant's case 12559M); and (6) U.S. non-provisional application Ser. No. 13/957,187 filed Aug. 1, 2013, entitled "Methods of Making Flexible Containers" published as US20140033655 (applicant's case 12579M2); (7) U.S. non-provisional application Ser. No. 13/889,000 filed May 7, 2013, entitled "Flexible Containers with Multiple Product Volumes" published as US20130292413 (applicant's case 12785M); (8) U.S. non-provisional application Ser. No. 13/889,061 filed May 7, 2013, entitled "Flexible Materials for Flexible Containers" published as US20130337244 (applicant's case 12786M); (9) U.S. non-provisional application Ser. No. 13/889,090 filed May 7, 2013, entitled "Flexible Materials for Flexible Containers" published as US20130294711 (applicant's case 12786M2); (10) U.S. provisional application 61/861,100 filed Aug. 1, 2013, entitled "Disposable Flexible Containers having Surface Elements" (applicant's case 13016P); (11) U.S. provisional application 61/861,106 filed Aug. 1, 2013, entitled "Flexible Containers having Improved Seam and Methods of Making the Same" (applicant's case 13017P); (12) U.S. provisional application 61/861,118 filed Aug. 1, 2013, entitled "Methods of Forming a Flexible Container" (applicant's case 13018P); (13) U.S. provisional application 61/861,129 filed Aug. 1, 2013, entitled "Enhancements to Tactile Interaction with Film Walled Packaging Having Air Filled Structural Support Volumes" (applicant's case 13019P); (14) Chinese patent application CN2013/085045 filed Oct. 11, 2013, entitled "Flexible Containers Having a Squeeze Panel" (applicant's case 13036); (15) Chinese patent application CN2013/085065 filed Oct. 11, 2013, entitled "Stable Flexible Containers" (applicant's case 13037); (16) U.S. provisional application 61/900,450 filed Nov. 6, 2013, entitled "Flexible Containers and Methods of Forming the Same" (applicant's case 13126P); (17) U.S. provisional application 61/900,488 filed Nov. 6, 2013, entitled "Easy to Empty Flexible Containers" (applicant's case 13127P); (18) U.S. provisional application 61/900,501 filed Nov. 6, 2013, entitled "Containers Having a Product Volume and a Stand-Off Structure Coupled Thereto" (applicant's case 13128P); (19) U.S. provisional application 61/900,508 filed Nov. 6, 2013, entitled "Flexible Containers Having Flexible Valves" (applicant's case 13129P); (20) US provisional application 61/900,514 filed Nov. 6, 2013, entitled "Flexible Containers with Vent Systems" (applicant's case 13130P); (21) U.S. provisional application 61/900,765 filed Nov. 6, 2013, entitled "Flexible Containers for use with Short Shelf-Life Products and Methods for Accelerating Distribution of Flexible Containers" (applicant's case 13131P); (22) U.S. provisional application 61/900,794 filed Nov. 6, 2013, entitled "Flexible Containers and Methods of Forming the Same" (applicant's case 13132P); (23) U.S. provisional application 61/900,805 filed Nov. 6, 2013, entitled "Flexible Containers and Methods of Making the Same" (applicant's case 13133P); (24) U.S. provisional application 61/900,810 filed Nov. 6, 2013, entitled "Flexible Containers and Methods of Making the Same" (applicant's case 13134P); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible container comprising:

a first web portion defined by a first periphery, a second web portion defined by a second periphery and disposed in a face to face relationship with the first web and at least partially overlapping the first web, at least a portion of the second periphery sealed to the first web, the sealed portion defining a first volume, which is a product volume, a roll bar dispensing aid disposed adjacent to the sealed portion of the second periphery and configured to be rolled along a dispensing path that compresses the product volume such that fluent product in the product volume is squeezed along the dispensing path toward a dispensing valve disposed at an end of the product volume, wherein the dispensing aid comprises third and fourth web portions sealed along a closed periphery and defining an expanded volume having a particular diameter.

2. The flexible container of claim 1 wherein the first and second web portions comprise portions of a common web sheet.

3. The flexible container of claim 1 wherein the first and third web portions comprise portions of a single web.

4. The flexible container of claim 1 wherein the second and fourth web portions comprise portions of a single web.

5. The flexible container of claim 1 wherein the dispensing aid is expanded by the presence of a gas.

6. The flexible container of claim 1 further comprising a dispensing aid stabilizing element disposed along a path of the dispensing aid.

7. The flexible container of claim 6 wherein the dispensing stabilizing aid comprises a perforation disposed in the sealed periphery of the second web portion.

8. The flexible container of claim 1 wherein the entire second periphery is sealed to the first web.

9. The flexible container according to claim 8 further comprising: a frangible seal.

10. The flexible container of claim 9 wherein the dispensing aid is disposed in opposition to the frangible seal.

11. A flexible container comprising:

a first web portion defined by a first periphery, a second web portion defined by a second periphery and disposed in a face to face relationship with the first web and at least partially overlapping the first web, at least a portion of the second periphery sealed to the first web, the sealed portion defining a first volume, which is a product volume, a roll bar dispensing aid disposed adjacent to the sealed portion of the second periphery and configured to be rolled along a dispensing path that compresses the product volume such that fluent product in the product volume is squeezed along the dispensing path toward a dispensing valve disposed at an end of the product volume, wherein the dispensing aid comprises third and fourth web portions sealed along a closed periphery and defining an expanded volume having a particular diameter;

the dispensing valve comprising first and second expanded volumes disposed adjacent one to the other and defining a gap therebetween, wherein each of the expanded volumes comprise sub-portions of the first and second web portions sealed along a closed periphery, wherein the expanded volumes are disposed opposite of the roll bar dispensing aid, wherein the gap comprises sub-portions of the first and second web portions arrayed in a face to face relationship, wherein the dispensing valve is disposed adjacent to the first volume.

12. The flexible container of claim 11 wherein the first and second web portions comprise portions of a common web sheet.

13. The flexible container of claim 11 wherein the first and third web portions comprise portions of a single web.

14. The flexible container of claim 11 wherein the second and fourth web portions comprise portions of a single web.

15. The flexible container of claim 11 wherein the dispensing aid is expanded by the presence of a gas.

16. The flexible container of claim 11 further comprising a dispensing aid stabilizing element disposed along a path of the dispensing aid.

17. The flexible container of claim 16 wherein the dispensing stabilizing aid comprises a perforation disposed in the sealed periphery of the second web portion.

18. The flexible container of claim 11 wherein the entire second periphery is sealed to the first web.

19. The flexible container according to claim 18 further comprising: a frangible seal.

20. The flexible container of claim 19 wherein the dispensing aid is disposed in opposition to the frangible seal.

* * * * *